US005774935A

United States Patent [19]

Hawley

[11] Patent Number: 5,774,935

[45] Date of Patent: Jul. 7, 1998

[54] HINGE AND METHOD FOR JOINING AND ALIGNING TWO PANELS

[75] Inventor: Jesse E. Hawley, Phoenix, Ariz.

[73] Assignee: Robert P. Reisman, Scottsdale, Ariz.

[21] Appl. No.: 807,654

[22] Filed: Feb. 27, 1997

[51] Int. Cl.[6] ..... E05D 5/00

[52] U.S. Cl. ..... 16/382; 16/367; 16/384

[58] Field of Search ..... 16/382, 383, 384, 16/387–392, 221, 235, 272, 367; 29/11

[56] References Cited

U.S. PATENT DOCUMENTS

| | | | |
|---|---|---|---|
| 1,100,684 | 6/1914 | Stoakes | 16/367 |
| 2,714,741 | 8/1955 | Derman | 16/384 |
| 3,081,482 | 3/1963 | Guerrant | 16/384 |
| 5,005,256 | 4/1991 | Jang | 16/384 |
| 5,195,214 | 3/1993 | Lautenschlager et al. . | |
| 5,239,730 | 8/1993 | Grass . | |
| 5,388,309 | 2/1995 | Grass . | |
| 5,406,677 | 4/1995 | Grass . | |

FOREIGN PATENT DOCUMENTS

| | | | |
|---|---|---|---|
| 1409898 | 7/1965 | France | 16/367 |
| 556232 | 8/1932 | Germany | 16/384 |
| 5082 of 1890 | | United Kingdom | 16/384 |

*Primary Examiner*—Chuck Mah
*Attorney, Agent, or Firm*—Richard E. Oney

[57] ABSTRACT

A hinge for joining and aligning two panels includes hinge leaves, each having an integral projection for insertion into a recess in one of the panels. Each of the leaf projections is disposed along an imaginary right circular cylinder having its center axis intersecting the hinge axis and the center axis of the imaginary cylinder of the other leaf projection. When the leaves are positioned in parallel, opposing relationship, the axes of the imaginary cylinders are coincident and the alignment of the hinge axis can be adjusted by rotating the hinge when it is inserted into hinge-mounting recesses that allow for such hinge rotation, such as arcuate. A hinged panel assembly includes the hinge mounted in arcuate grooves that allow for hinge rotation, such as semicircular grooves. The semicircular grooves are formed by clamping the panels together in alignment and cutting a substantially circular groove that is bisected by the joint between the panels. The hinges are secured to the panels by fluid adhesive placed into the grooves. The hinges are aligned by rotating them in the grooves before the adhesive hardens. To prevent adhesive from flowing between the semicircular grooves, a barrier is placed between the semicircular grooves while the adhesive hardens.

25 Claims, 4 Drawing Sheets

HINGE AND METHOD FOR JOINING AND ALIGNING TWO PANELS

BACKGROUND

This invention relates generally to hinges and more specifically to a hinge and method for easily and efficiently joining two panels, such as a lid and side of a container of a box, in precision alignment.

One application where the hinged joining of panels in precision alignment is required is in the construction of thin-walled boxes having a lid joined to a container with hinges, such as wooden jewelry boxes, decorative boxes, craft boxes and the like. On such boxes, the hinges must be precisely aligned with the lid and the container, as well as with each other, to insure that the lid and container will be properly aligned and that the lid will open and close properly. Even a relatively small misalignment of the hinges can cause a noticeable misalignment of the lid and the container and can cause the lid to bind when it is closed.

Previously, the most difficult and time-consuming task in constructing such boxes has been the task of mounting the hinges on the box so that the lid and the container are in precision alignment. Typically such boxes are constructed using conventional rectangular-leaf hinges, each of which is mounted with the barrel of the hinge on the outside of the box. To do this, one must cut a mortise into the edge of each of the lid and the container. A leaf of the hinge is mounted into each of these mortises with screws that are driven through screw holes in the hinge leaf and into the mortised surface. The mortises must be precisely located and cut, usually with a chisel or a router, so that the mounting of the hinges to the mortised surfaces will not pull the lid and container out of alignment. This process of locating and cutting the mortises is relatively expensive and time consuming, often involving much readjustment. After the mortises are cut, the leaves of the hinge are mounted to the mortised surfaces with screws, which also must be precisely located. This is achieved by another relatively time-consuming process. Typically, two or more screws per hinge leaf are used. First, pilot holes for the screws are precisely located and drilled in the mortised surfaces of the lid and container, typically using a jig. The screws are then driven through the screw holes in the hinge leaves to fasten the hinge to the lid and container. Even if the pilot holes are carefully placed, small misalignments of the hinge can still occur when the screws are tightened due to the clearance and "play" between the screws and the screw holes in the hinge leaves. Even a slight misalignment of these screws can pull the lid and container into obvious misalignment. Precise alignment of the hinge is generally achieved through a trial-and-error process of tightening the screws to hold the hinges in place in estimated alignment, checking the corresponding lid-container alignment, then loosening one or more of the screws to adjust the hinge alignment to try to achieve the desired lid-container alignment. These steps often must be repeated a number of times to achieve acceptable alignment of the lid and the container.

Such boxes also have been constructed by mounting conventional hinges to the outside surface of the box lid and container. In this configuration, mortises are not used. Again, however, to assure proper alignment of the lid and the container, the hinge screws for all of the hinges must be precisely located and must be tightened by a painstaking and time-consuming, trial-and-error process like that described above.

There is a need, therefore for a hinge and a method for easily and efficiently joining two panels, such as a lid and side of a container of a box, in precision alignment. Accordingly, it is an object of this invention to provide such a hinge and method.

Additional objects and advantages of the invention will be set forth in the description which follows, and in part will be apparent from the description, or may be learned by practice of the invention. The objects and advantages of the invention may be realized and obtained by means of the instrumentalities and combinations pointed out in the appended claims.

SUMMARY

To achieve the foregoing objects, and in accordance with the purposes of the invention as embodied and broadly described in this document, I have provided a hinge for joining and aligning a first panel with a second panel where the first panel includes a first hinge-mounting surface having a first hinge-mounting recess and the second panel includes a second hinge-mounting surface having a second hinge-mounting recess. The first panel can be part of a lid of a box and the second panel can be part of a container of the box. The hinge has a first leaf hingedly joined to a second leaf so that the first and second leaves can pivot about a hinge axis. The first leaf includes an integral projection for insertion into the first hinge-mounting recess when the first leaf is mounted to the first hinge-mounting surface. The first leaf projection is disposed along an imaginary first right circular cylinder having its center axis intersecting the hinge axis. The second leaf includes an integral projection for insertion into the second hinge-mounting recess when the second leaf is mounted to the second hinge-mounting surface. The second leaf projection is disposed along an imaginary second right circular cylinder having its center axis intersecting the hinge axis and the first cylinder center axis. By disposing the leaf projections along imaginary cylinders having center axes that intersect each other and the hinge axis, the hinge axis alignment can be easily adjusted by rotating the hinge when the leaves are positioned in parallel, opposing relationship and are inserted into arcuate hinge-mounting recesses that allow for such hinge rotation.

Preferably, and for ease of manufacture, the first leaf projection comprises an arcuate flange disposed along an outer edge of the first leaf and the second leaf projection comprises an arcuate flange disposed along the outer edge of the second leaf, with the imaginary first and second cylinders have equal diameters. It is also preferred that each of the flanges have at least one hole through it to allow a fluid adhesive, such as unhardened epoxy or glue, to flow through the flange to form a stronger bond between the flange and the panel into which the flange is inserted. In another embodiment of the hinge, the first leaf projection can include one or more tabs disposed along the outer edge of the first leaf and the second leaf projection can include one or more tabs disposed along the outer edge of the second leaf.

A hinged panel assembly in accordance with my invention comprises a first panel including a first hinge-mounting surface having a first hinge-mounting recess, a second panel including a second hinge-mounting surface having a second hinge-mounting recess and at least one hinge for joining the first panel to the second panel in hinged relationship. The hinged panel assembly can be a hinged box lid and container. The hinge includes a first leaf hingedly joined to a second leaf so that the first leaf and the second leaf can pivot about a hinge axis. The first leaf is mounted to the first hinge-mounting surface and includes a first integral projection inserted into the first hinge-mounting recess. The first leaf projection is disposed along an imaginary first right circular cylinder having its center axis intersecting the hinge axis. The second leaf is mounted to the second hinge-mounting surface and includes a second integral projection inserted into the second hinge-mounting recess. The second leaf projection is disposed along an imaginary second right circular cylinder having its center axis intersecting the hinge axis and the first cylinder center axis.

In a preferred embodiment of the hinged panel assembly and for ease of manufacture, the imaginary first and second cylinders of the hinge have equal diameters and each of the first leaf projection and the second leaf projection of the hinge comprises an arcuate flange. It is also preferred that each flange have at least one hole through it to allow fluid adhesive to flow through the flange for the reason described above. In an alternate embodiment, at least one of the first leaf projection and the second leaf projection can include a tab.

Preferably, the hinge-mounting recesses are dimensioned to allow rotation of the hinge when the leaf projections are inserted into the hinge-mounting recesses, such as when the hinge-mounting recesses are arcuate flanges sized to allow such hinge rotation. It is preferred, for ease of manufacture, that the first hinge-mounting recess and the second hinge-mounting recess be substantially semicircular grooves and that they be located and dimensioned to form a substantially circular groove when the first panel and the second panel are aligned in abutting relationship, with the abutting first and second panel forming a joint that bisects the substantially circular groove. In this configuration, the hinge can be easily manufactured and multiple hinges can be easily aligned with each other.

In accordance with my invention, a method of hingedly joining and aligning a first panel having a first hinge-mounting surface with a second panel having a second hinge-mounting surface includes providing a hinge having a first leaf hingedly joined to a second leaf so that the first and second leaves can pivot about a hinge axis. The first leaf includes an integral projection disposed along an imaginary first right circular cylinder having its center axis intersecting the hinge axis. The second leaf includes an integral projection disposed along an imaginary second right circular cylinder having its center axis intersecting the hinge axis and the first cylinder center axis. A first hinge-mounting recess is formed in the first hinge-mounting surface for receiving the first leaf projection, and a second hinge-mounting recess is formed in the second hinge mounting surface for receiving the second leaf projection. The first leaf projection is inserted into the first hinge-mounting recess and the second leaf projection is inserted into the second hinge-mounting recess. The hinge axis is aligned. The first leaf projection is secured into the second hinge mounting recess, and the second leaf projection is secured into the second hinge-mounting recess.

In a preferred method of joining and aligning the panels, the step of aligning the hinge axis includes forming the first and second hinge mounting recesses to allow rotation of the hinge when the leaf projections are inserted into the hinge-mounting recesses. For ease of manufacture, the step of forming the first hinge-mounting recess and the second hinge-mounting recess includes clamping the first panel and the second panel together in aligned and abutting relationship along a joint and forming a substantially circular groove in the aligned and abutting first and second hinge-mounting surfaces so that the circular groove is intersected by the joint. Preferably, the circular groove is located so that the first and second hinge mounting recesses are substantially semicircular grooves.

Also in a preferred method of joining and aligning the panels, the step of aligning the hinge includes rotating the hinge in the first and second hinge-mounting recesses and the step of securing the leaf projections into the first hinge-mounting surface includes filling the hinge-mounting recesses with an adhesive and inserting the leaf projections into the hinge-mounting recesses. To prevent adhesive from flowing between the first hinge-mounting recess and the second hinge-mounting recess, a barrier is placed between the first recess and the second recesses. With the first and second hinge-mounting recesses forming a substantially circular groove when the first and second panels are in aligned and abutting relationship, this barrier can be formed by placing a strip of adhesive tape between the first and second hinge-mounting recesses.

A preferred method of making a hinge in accordance with my invention includes providing a conventional hinge having a first substantially flat leaf and a second substantially flat leaf hingedly connected so that the leaves can pivot about a hinge axis. A first arcuate flange is formed along an outer edge of the first flat leaf generally opposite the hinge axis. The first arcuate flange is disposed along an imaginary first right circular cylinder having a center axis intersecting the hinge axis. A second arcuate flange is formed along an outer edge of the second flat leaf generally opposite the hinge axis. The second arcuate flange is disposed along an imaginary second right circular cylinder having a center axis intersecting the hinge axis and the first cylinder center axis.

BRIEF DESCRIPTION OF THE DRAWINGS

The accompanying drawings, which are incorporated in and constitute a part of the specification, illustrate the presently preferred embodiments and methods of the invention and, together with the general description given above and the detailed description of the preferred embodiments and methods given below, serve to explain the principles of the invention.

DESCRIPTION

Figure 1A:
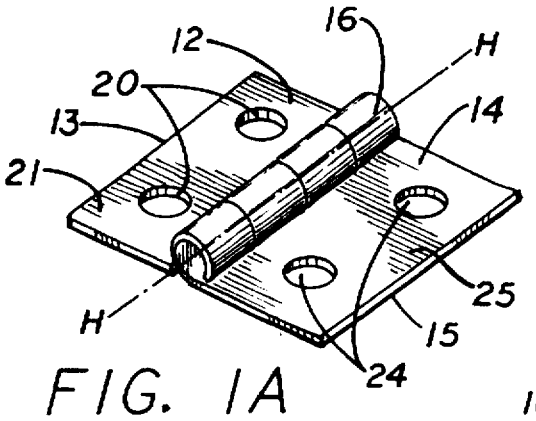
FIG. 1A is a top perspective view of a conventional rectangular-leaf hinge with the leaves positioned in substantially parallel, opposing relationship.

Reference will now be made in detail to the presently preferred embodiments and methods of the invention as illustrated in the accompanying drawings, in which like reference characters designate like or corresponding parts throughout the drawings.

Figure 1C:
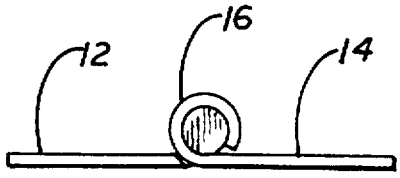
FIG. 1C is a sectional side view taken through line 1C—1C of FIG. 1B.
Figure 1B:
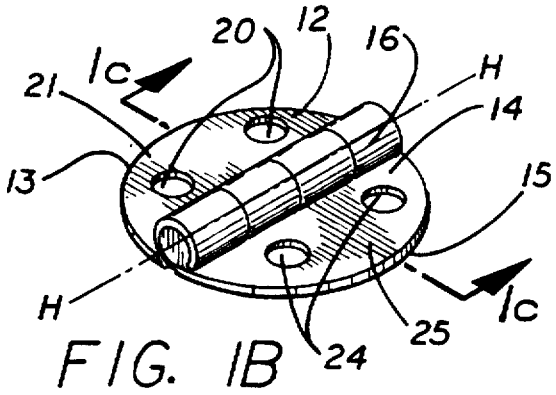
FIG. 1B is a top perspective view of the hinge of FIG. 1A after the outer side of each of the hinge leaves has been rounded.
Figure 1D:
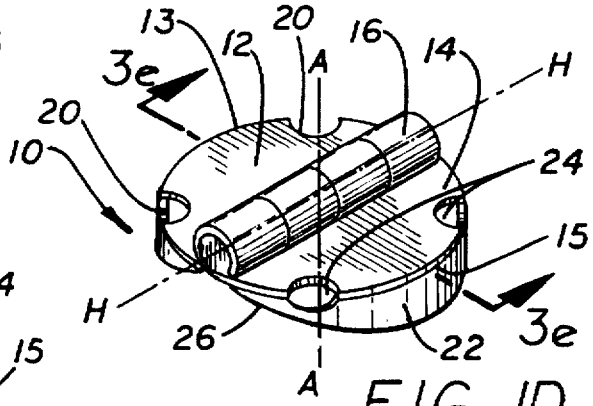
FIG. 1D is a top perspective view of a hinge in accordance with my invention, which shows the hinge of FIG. 1B after the outer side of each of the hinge leaves has been bent to form an arcuate flange.
Figure 1E:
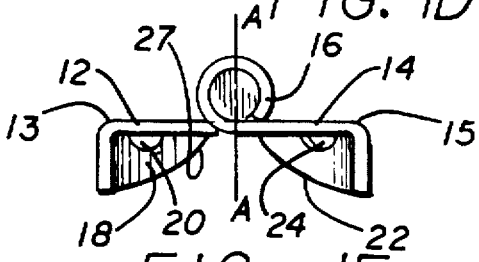
FIG. 1E is a sectional side view taken through line 1E—1E of FIG. 1D.
Figure 1F:
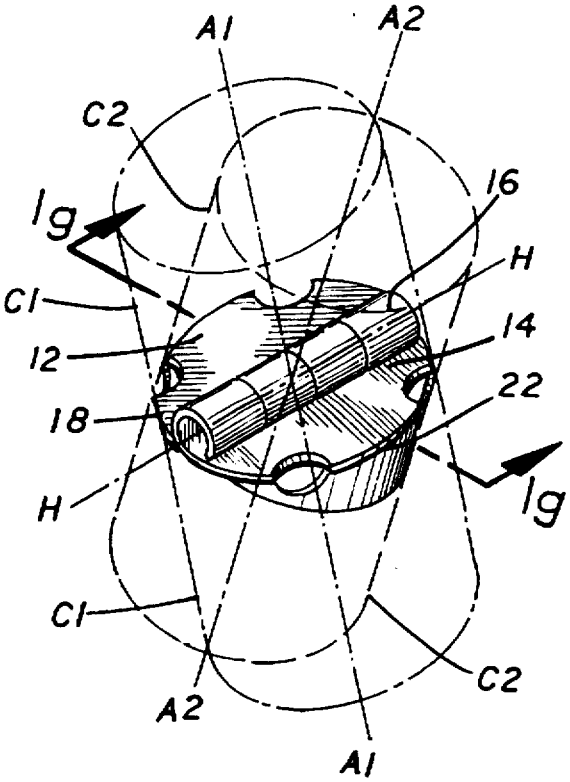
FIG. 1F is a top perspective view of the hinge of FIG. 1D, showing the hinge leaves positioned in a non-parallel orientation and showing the imaginary cylinders along which the leaf projections are disposed.
Figure 1G:
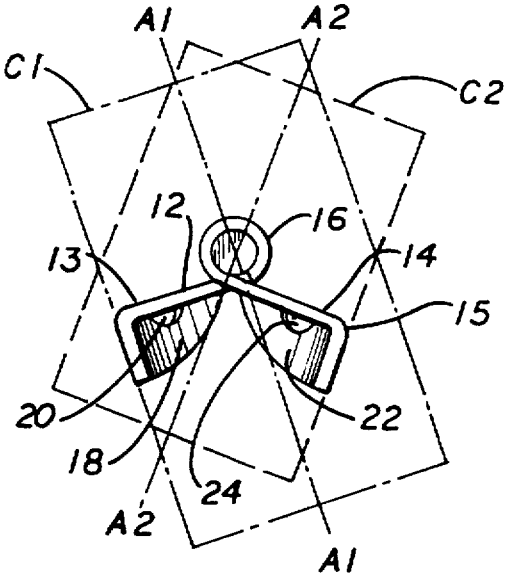
FIG. 1G is a sectional side view taken through line 1G—1G of FIG. 1F.

Referring to FIGS. 1D–1F, a preferred embodiment of a hinge 10 in accordance with my invention includes a first leaf 12 hingedly connected to a second leaf 14 by a hinge barrel 16 disposed along a hinge axis H about which the hinge leaves 12, 14 pivot. The first leaf 12 includes a first leaf projection 18 comprising an arcurate flange disposed along a first leaf outer edge 13 opposite the barrel 16 and the hinge axis H. The second leaf 14 includes a second leaf projection 22 also comprising an arcurate flange disposed along a second leaf outer edge 15 opposite the barrel 16 and the hinge axis H. The second leaf projection 22 has holes 24 through it.

Referring again to FIG. 1F, the first leaf projection 18 is disposed along a first imaginary circular right cylinder C1 having a center axis A1 intersecting the hinge axis H. The second leaf projection 22 is disposed along a second imaginary circular right cylinder C2 having a center axis A2 intersecting the hinge axis H and the first cylinder center axis A1. When the first leaf 12 and the second leaf 14 are positioned in substantially parallel, opposing relationship, as shown in FIGS. 1D and 1E, the imaginary cylinder axes A1, A2 are coincident on an axis A and the leaves 12, 14 are substantially coplanar. With the leaves 12, 14 in this position, the hinge 10 has a generally cylindrical shape with the cylinder wall being formed by the flanges 18, 22 and having notched openings 26, 27 at each end of the hinge barrel 16.

Figure 5:
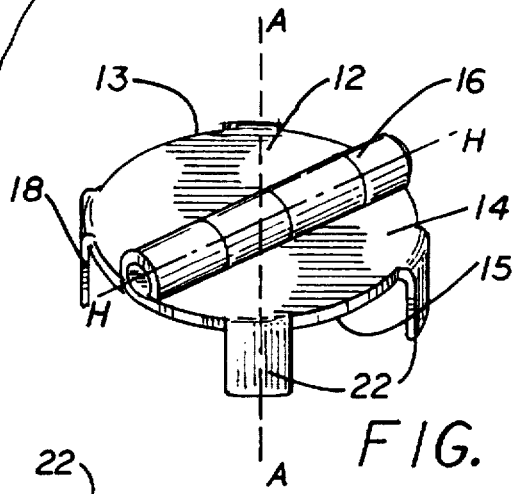
FIG. 5 is a top perspective view of an alternative embodiment of a hinge in accordance with my invention showing the leaf projections as tabs disposed on the outer edge of each of the semicircular leaves.
Figure 6:
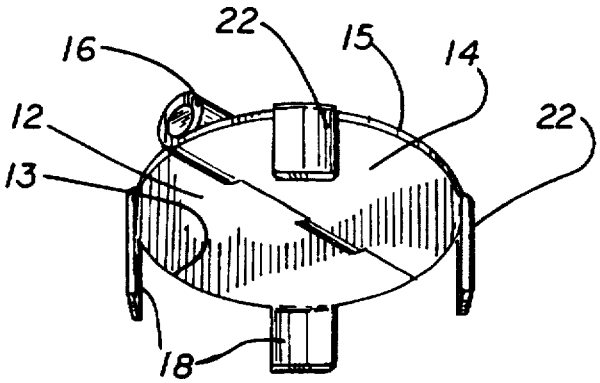
FIG. 6 is a bottom perspective view of the hinge of FIG. 5.
Figure 7:
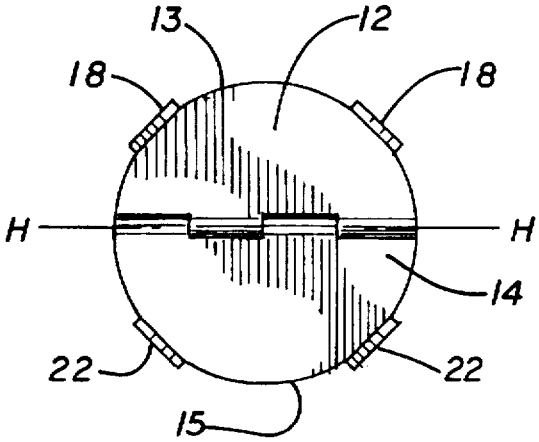
FIG. 7 is a bottom plan view of the hinge of FIG. 5.

Referring to FIGS. 5–7, in an alternative embodiment of a hinge in accordance with my invention, the first and second hinge leaves 12, 14 are generally semicircular in shape and the first and second leaf projections 18, 22 are tabs disposed along the first and second leaf outer edges 13, 15.

FIGS. 1A–1D show a preferred method for manufacturing a hinge 10 in accordance with my invention. FIG. 1A shows a conventional hinge with substantially flat, rectangular leaves 12, 14 hingedly connected along a hinge axis H by a hinge barrel 16. The hinge leaves 12, 14 each have screw holes 20, 24 through them, respectively. Referring to FIGS. 1B and 1C, the outer side 21 of the first hinge leaf 12 and the outer side 25 of second hinge leaf 14 are cut to have rounded outer edges. This can be achieved by using a conventional punch press with a circular blanking die (not shown) having a diameter that is greater than the length of the hinge barrel 16. The blanking die includes a slot through its center dimensioned to receive the hinge barrel 16, into which the hinge barrel 16 is inserted to locate and hold the hinge during the cutting process. Referring again to FIG. 1D, the hinge 10 is completed by bending the outer side 21 of hinge leaf 12 to form a first leaf projection 18 and by bending the outer side 25 of leaf 14 to form the second leaf projection 22. This can be done by using a punch press with a circular forming die (not shown) having a diameter slightly greater than the length of the hinge barrel 16 and less than the diameter of the blanking die. The punch press plunger has a center slot for receiving the hinge barrel 16 to locate and hold the hinge 10 during the forming process.

Figure 3A:
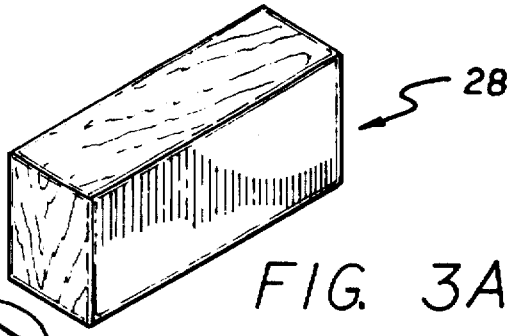
FIG. 3A is a perspective view of the enclosed box referenced in the first step shown in FIG. 2.
Figure 3B:
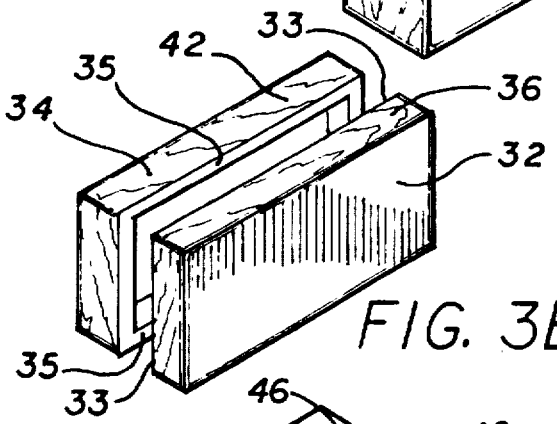
FIG. 3B is a perspective view of the box of FIG. 3A after it has been split to form a lid and a container.
Figure 3D:
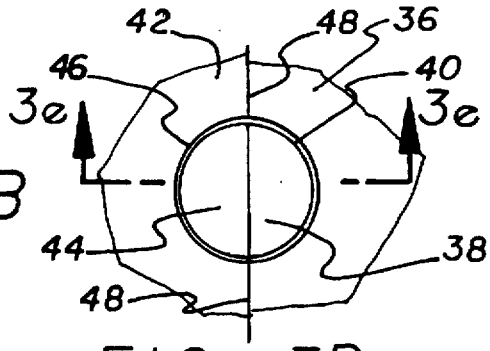
FIG. 3D is an enlarged detail, in top plan view, of a portion of FIG. 3C showing two semicircular hinge-mounting recesses aligned to form a circular groove in the hinge mounting surfaces of the aligned and abutted lid and container.
Figure 3C:
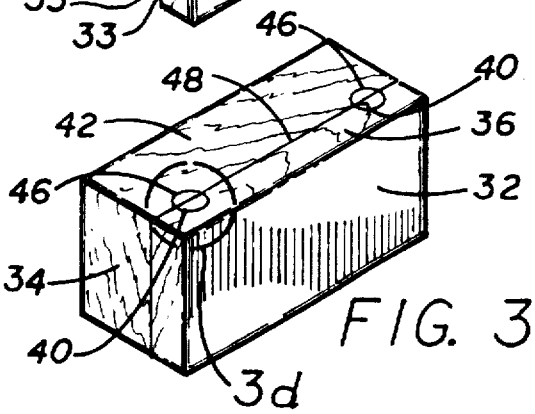
FIG. 3C is a perspective view showing the lid and container of FIG. 3B aligned together with the hinge-mounting surfaces of the lid and container facing upward and showing the hinge-mounting recesses as semicircular grooves in the hinge-mounting surfaces.
Figure 3E:
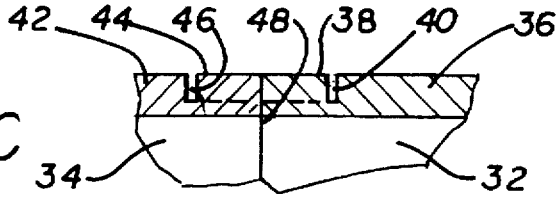
FIG. 3E is a sectional side view taken along line 3E—3E of FIG. 3D showing the abutting relationship of the lid and container and the alignment of the semicircular hinge-mounting recesses.
Figure 3F:
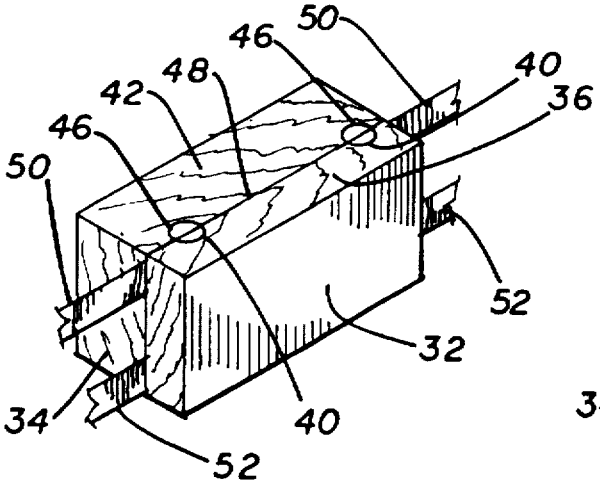
FIG. 3F is a perspective view of the aligned box and lid of FIG. 3C showing the adhesive tape placed along the interior edges of the aligned box and lid to act as a removable barrier between the aligned first and second hinge-mounting recesses.
Figure 3G:
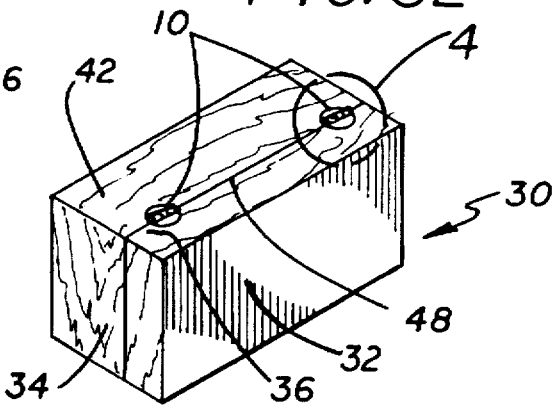
FIG. 3G is a perspective view of a hinged box in accordance with my invention placed on its side with the hinge leaf projections mounted into the aligned, semicircular hinge-mounting recesses in the aligned lid and container.

Referring to FIG. 3G, a preferred embodiment of a hinged box 30 in accordance with my invention comprises a lid 32 and a container 34 joined by hinges 10 mounted to the lid 32 and the container 34. Referring also to FIG. 3D, the container 34 includes a panel 42 having a hinge-mounting surface 38 with a hinge-mounting recess 40 therein for each hinge 10 to be mounted to the box 30. The lid 32 includes a panel 36 having a hinge-mounting surface 40 with a hinge-mounting recess 46 therein for each hinge to be mounted to the box 30. Referring also to FIGS. 3A and 3G, a joint 48 is formed at an interior edge 33 of the lid 32 and an interior edge 35 of the container 34 along the lid and container panels 36, 40 when the box 30 is closed with the lid 32 and the container 34 in aligned and abutting relationship. The container hinge-mounting recess 40 is an arcuate groove sized to receive the first leaf projection 18, and the lid hinge-mounting recess 46 is an arcuate groove sized to receive the second leaf projection 22. Preferably, each of the hinge-mounting recesses 40, 46 are substantially semicircular in shape and are dimensioned and located so that they align to form a substantially circular groove when the box 30 is closed with the lid 32 and the container 34 in aligned and abutting relationship.

Figure 2:
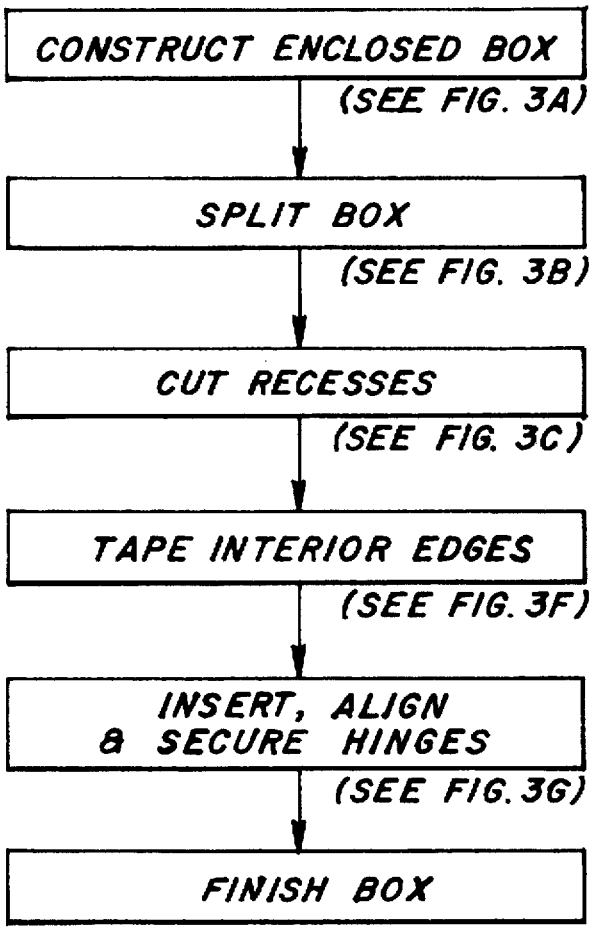
FIG. 2 is a block diagram showing steps of a preferred method of constructing a hinged box in accordance with my invention.

Referring to FIG. 2, the hinged box 30 is made from an enclosed box 28, as shown in FIG. 3A, which can be constructed using well-known methods. The enclosed box 28 is split, such as by sawing it in two with a band saw, thereby forming the lid 32 and the container 34, as shown in FIG. 3B. The lid interior edge 33 and the container interior edge 35, are then planed to ensure that the lid 32 and container 34 will join precisely around their entire periphery when they are placed together in aligned, abutting relationship. This planing can be achieved using a router or a milling machine. The lid hinge-mounting recess 40 is formed in the lid panel 36 and the container hinge-mounting recess 46 is formed in the container panel 42, preferably as follows. The lid 32 and the container 34 are clamped together in aligned and abutting relationship with the lid panel 36 and the container panel 42 abutting to form the joint 48. The semicircular hinge-mounting recesses 40, 46 are then formed in the hinge-mounting surfaces 38, 44 of the aligned and abutting panels 36, 40 by cutting a circular groove that is located so that it is bisected by the joint 48. The circular groove is sized to closely receive the hinge leaf projections 18, 22 but to allow rotation of the hinge 10 in the circular groove. This can be achieved by cutting a circular groove with a drill press using a cutting tool such as a conventional hole saw or an adjustable boring head having a cutting bit. This process is repeated to form a circular groove for each hinge 10 to be mounted to the box 30. Multiple circular grooves can easily be aligned a uniform distance between the top of the lid 32 and the bottom of the container 34 by positioning the assembly of the clamped lid 32 and container 34 against a fence as each of the circular grooves is cut. Preferably, though not necessarily, the circular groove can be centered on the joint 48.

Figure 4:
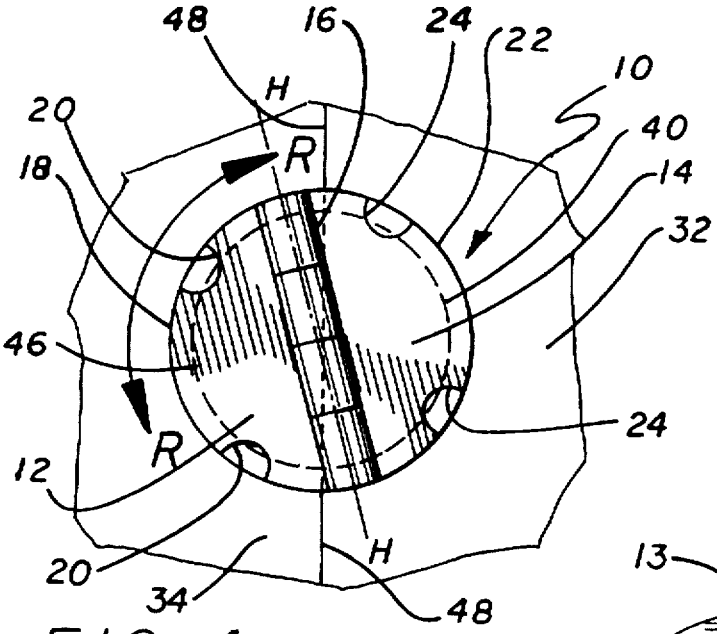
FIG. 4 is an enlarged detail, in top plan view, of a portion of FIG. 3G showing the hinge leaf projections inserted in the aligned, semicircular hinge-mounting recesses with the hinge barrel out of proper alignment and showing that the hinge can be rotated within the hinge-mounting recesses to adjust the hinge axis alignment.

Referring to FIGS. 3G and 4, the hinges 10 are mounted to the box 30. A removable barrier 50 is placed along the joint 48 between the semicircular hinge mounting recesses 40, 46 to prevent fluid adhesive placed in either of the semicircular hinge-mounting recesses 40, 46 from flowing across the joint 48 and thereby bonding the lid panel 36 to the container panel 42. Preferably, this is achieved by unclamping the lid 32 and the container 34 after the semicircular hinge-mounting recesses 40, 46 have been cut and placing a strip of adhesive tape 50 along the lid inner edge 33 or the container inner edge 35 between the hinge mounting recesses 40, 46. When placed in this manner, the strip of adhesive tape 50 will cause a small spacing between the lid and container inner edges 33, 35 along the lid panel 36 and the container panel 42 when the lid 32 and the container 34 are aligned together in abutting relationship. To prevent the hinge from binding when the box 30 is completed, a second strip of adhesive tape 52 is placed along the lid inner edge 33 or the container inner edge 35 opposite the lid and container panels 36, 40 to provide a spacing corresponding to the spacing between the lid and container panels 36, 42. This small corresponding spacing will prevent the hinges 10 of the completed box 30 from binding when the box is closed.

After the strips of tape 50, 52 are in place, the lid 32 and the box 34 are again clamped together in alignment. A suitable amount of adhesive, preferably an epoxy resin or a cyanoacrylate ester, is deposited into each of the hinge-mounting recesses 40, 46. The first leaf projection 18 is inserted into the container hinge-mounting recess 46 and the second leaf projection 22 is inserted into the lid hinge-mounting recess 40 with the hinge 10 aligned so that the hinge axis H is roughly parallel to the joint 48. When the hinge 10 is inserted in this manner, the notches 26, 27 in the cylindrically-shaped hinge 10 straddle the barrier between the hinge-mounting recesses 40, 46 formed by the first adhesive tape strip 50. The holes 20, 24 in the hinge leaf projections 18, 22 will allow the adhesive to flow through the hinge leaf projections 18, 22 to provide a better bond for securing each of the hinge leaf projections to the panel into which it is inserted.

The alignment of the hinge 10 can be easily adjusted before the adhesive hardens by rotating the hinge 10 in the circular groove formed by the aligned semicircular hinge-mounting recesses 40, 46, as shown by the bidirectional arrow R in FIG. 4, until the hinge axis H is substantially parallel to the joint 48. An additional amount of adhesive can also be placed on the hinge-mounting surfaces 38, 40 inside the circumference of each of the hinge-mounting recesses 40, 46, provided that this adhesive is not permitted to flow across the joint 48 and to bond the lid panel 36 to the container panel 42. When more than one hinge 10 is mounted to the box 30, each of the hinge axes H of the hinges 10 can easily and accurately be aligned in colinear relationship using a jig (not shown) having a straight slot dimensioned to closely fit over the hinge barrels 16 of all of the hinges 10 simultaneously. After the hinges 10 are inserted into the hinge-mounting recesses 40, 46 and roughly aligned by hand, the slotted jig is pressed over all of the hinge barrels 16, thereby twisting the hinges 10 into colinear alignment. The slotted jig is held in place until the adhesive hardens, securing the hinges 10 in place in proper alignment. Thereafter, the jig and the adhesive tape strips 50, 52 can easily be removed and the box can be finished, e.g. by applying paint, stain or the like.

I have manufactured the embodiment of the hinge shown in FIG. 1D using a conventional metal, rectangular-leaf hinge of the type shown in FIG. 1A. Each of the leaves of the conventional hinge measured approximately ½ inch (from the outer edge of the leaf to the hinge axis) by ¾ inch, and was approximately 1/40 inch thick. Each leaf had two circular screw holes having a diameter of about ⅛ inch. Using the blanking operation described above, the leaf outer sides 21, 25 were rounded by cutting them using a circular blanking die measuring about 0.950 inch in diameter. This resulted in a hinge 10 of the configuration shown in FIG. 1D with the hinge diameter along line 1C—1C measuring about 0.952 inch. A circular forming die with a punch diameter of approximately 0.699 inch was used in the forming process described above, resulting in a hinge of the configuration shown in FIG. 1D with a diameter along line 1E—1E measuring approximately ¾ inch, a maximum flange height of about 3/16 inch and a flange thickness of about 1/40 inch.

I have manufactured boxes of the type shown in FIG. 3G using the method shown in FIG. 2 and FIGS. 3A–3G. The enclosed box 28 was made of walnut and measured about 8 inches by 2½ inches by 1¾ inches. Two hinges of the type described in the preceding paragraph were mounted to the box 30. The semicircular hinge-mounting recesses were formed by cutting circular grooves in the hinge-mounting surfaces of the clamped lid 32 and container 34 using a metal cutting hole saw having a nominal diameter of ¾ inch which hole saw was then ground to cut hinge-mounting recesses having an inner diameter of about 0.665 inch and an outer diameter of about 0.755 inch. In this size, each of the hinge-mounting recesses provided about 0.005 inch clearance on each side of the hinge flange to allow for easy insertion of the hinge. I used epoxy and a cyanoacrylate ester as adhesive for securing the hinges to the boxes on separate occasions. Cyanoacrylate ester sold under the trademark SLO-ZAP marketed by Pacer Technology is preferred because it is available in a bottle having a long-neck applicator, which facilitates injecting the adhesive into the narrow hinge-mounting recesses.

The above-described embodiments and methods possess several advantages. By disposing the leaf projections along imaginary cylinders having center axes that intersect each other and the hinge axis, the hinge axis alignment can be easily adjusted by rotating the hinge when the hinge leaves are positioned in parallel, opposing relationship and are inserted into hinge-mounting recesses that allow such rotation. By making the leaf projections arcuate flanges and by disposing the leaf projections along imaginary cylinders with equal diameters, the hinge can be easily manufactured. By providing at least one hole in a leaf projection, fluid adhesive can form a stronger bond between the projection and the panel into which it is inserted. By making the hinge-mounting recesses substantially semicircular grooves located and dimensioned to form a circular groove when the panels are aligned in abutting relationship, the hinge-mounting recesses can be easily located and formed by cutting them using a conventional tools, such as a drill press, a hole saw and a fence, and multiple hinges can be easily mounted in alignment with each other.

Additional advantages and modifications will readily occur to those skilled in the art. For example, the hinge leaves and hinge leaf projections can be of many different shapes so long as each of the hinge leaf projections is disposed along an imaginary right circular cylinder having its center axis intersecting the hinge axis and the center axis of the other right circular cylinder. As another example, the hinge mounting recesses can be of various shapes that allow rotation of the inserted hinge. As another example, although it is preferred for ease of manufacture to dispose the hinge projections along imaginary cylinders having equal diameters, the projections can be disposed along imaginary cylinders with unequal diameters. Therefore, the invention in its broader aspects is not limited to the specific details, representative devices, and illustrative examples shown and described. Accordingly, departures may be made from such details without departing from the spirit or scope of the general inventive concept as defined by the appended claims and their equivalents.

What is claimed is:

1. A hinge for joining and aligning a first panel with a second panel, the first panel including a first hinge-mounting surface having a first hinge-mounting recess and the second panel including a second hinge-mounting surface having a second hinge-mounting recess, the hinge comprising:

a first leaf hingedly joined to a second leaf so that the first and second leaves can pivot about a hinge axis;

the first leaf including a projection for insertion into the first hinge-mounting recess when the first leaf is mounted to the first hinge-mounting surface, the first leaf projection being disposed along an imaginary first right circular cylinder having a center axis intersecting the hinge axis;

the second leaf including a projection for insertion into the second hinge-mounting recess when the second leaf is mounted to the second hinge-mounting surface, the second leaf projection being disposed along an imaginary second right circular cylinder having a center axis intersecting the hinge axis and the first cylinder center axis and at least one of the first leaf projection and the second leaf projection comprising at least one arcuate flange.

2. The hinge of claim 1 wherein the imaginary first and second cylinders have equal diameters.

3. The hinge of claim 2 wherein the hinge comprises a generally cylindrical cup shape having a notch at each end of the cup near the hinge axis when the first leaf and the second leaf are positioned in substantially coplanar relationship.

4. The hinge of claim 1 wherein the at least one flange has at least one hole through it.

5. The hinge of claim 1 wherein the first leaf projection is disposed along an outer edge of the first leaf.

6. The hinge of claim 5 wherein the second leaf projection is disposed along an outer edge of the second leaf.

7. A hinged panel assembly comprising:

a first panel including a first hinge-mounting surface having a first hinge-mounting recess;

a second panel including a second hinge-mounting surface having a second hinge-mounting recess; and at least one hinge for joining the first panel to the second panel in hinged relationship, the at least one hinge comprising:

a first leaf hingedly joined to a second leaf so that the first and second leaves can pivot about a hinge axis;

the first leaf being mounted to the first hinge mounting surface and including an integral projection inserted into the first hinge-mounting recess, the first leaf projection being disposed along an imaginary first right circular cylinder having a center axis intersecting the hinge axis; and the second leaf being mounted to the second hinge-mounting surface and including an integral projection inserted into the second hinge mounting surface recess, the second leaf projection being disposed along an imaginary second right circular cylinder having a center axis intersecting the hinge axis and the first cylinder center axis.

8. The hinged panel assembly of claim 7 wherein the imaginary first and second cylinders have equal diameters.

9. The hinged panel assembly of claim 7 wherein at least one of the first leaf projection and the second leaf projection comprises an arcuate flange.

10. The hinge of claim 9 wherein the flange has at least one hole through it.

11. The hinged panel assembly of claim 7 wherein at least one of the first leaf projection and the second leaf projection comprises a tab.

12. The hinged panel assembly of claim 7 wherein the hinged mounting recesses are dimensioned to allow rotation of the hinge when the leaf projections are inserted into the hinge-mounting recesses.

13. The hinged panel assembly of claim 7 wherein at least one of the first hinge-mounting recess and the second hinge-mounting recess is an arcuate groove.

14. The hinged panel assembly of claim 7 wherein at least one of the first hinge-mounting recess and the second hinge-mounting recess is a substantially semicircular groove.

15. The hinged panel assembly of claim 7 wherein:

the first hinge-mounting recess and the second hinge-mounting recess define a substantially circular groove when the first panel and the second panel are aligned in abutting relationship.

16. The hinged panel assembly of claim 15 wherein the aligned and abutted first and second panel form a joint that bisects the substantially circular groove.

17. A method of hingedly joining and aligning a first panel having a first hinge-mounting surface with a second panel having a second hinge-mounting surface, the method comprising:

providing a hinge including a first leaf hingedly joined to a second leaf so that the first arid second leaves can pivot about a hinge axis, the first leaf including an integral projection disposed along an imaginary first right circular cylinder having a center axis intersecting the hinge axis, and the second leaf including an integral projection disposed along an imaginary second right circular cylinder having a center axis intersecting the hinge axis and the first cylinder center axis;

forming a first hinge-mounting recess in the first hinge-mounting surface for receiving the first leaf projection and a second hinge-mounting recess in the second hinge mounting surface for receiving the second leaf projection;

inserting the first leaf projection into the first hinge-mounting recess and inserting the second hinge projection into the second hinge-mounting recess; aligning the hinge axis; and securing the first leaf projection into the second hinge mounting recess and securing the second leaf projection into the second hinge-mounting recess.

18. The method of hingedly joining and aligning a two panels of claim 17, wherein the step of forming the first and second hinge mounting recesses includes forming the first and second hinge-mounting recesses to allow rotation of the hinge when the leaf projections are inserted into the hinge-mounting recesses.

19. The method of hingedly joining and aligning two panels of claim 18, wherein the step of aligning the hinge axis includes rotating the hinge in the first and second hinge-mounting recesses.

20. The method of hingedly joining and aligning two panels of claim 17, wherein the step of forming the first hinge-mounting recess and the second hinge-mounting recess comprises:

clamping the first panel and the second panel together in aligned and abutting relationship along a joint; and forming a substantially circular groove in the first and second hinge mounting surfaces of the aligned and abutting first and second panels so that the circular groove is intersected by the joint.

21. The method of hingedly joining and aligning a two panels of claim 17, wherein the step of forming the first hinge-mounting recess and the second hinge-mounting recess comprises forming at least one of the hinge-mounting recesses as a substantially semicircular groove.

22. The method of hingedly joining and aligning two panels of claim 17, wherein the step of securing the first leaf projection into the first hinge-mounting surface comprises:

filling the first hinge-mounting recess with an adhesive; and inserting the first leaf projection into the first hinge-mounting recess.

23. The method of hingedly joining and aligning two panels of claim 22, wherein the step of filling the first hinge-mounting recess includes placing a barrier between the first hinge-mounting recess and the second hinge-mounting recess to prevent adhesive from flowing between the first hinge-mounting recess and the second hinge-mounting recess.

24. The method of hingedly joining and aligning two panels of claim 23, wherein the step of placing the barrier between the first hinge-mounting recess and the second hinge-mounting recess includes placing a strip of adhesive tape between the first hinge-mounting recess and the second hinge-mounting recess.

25. A method of making a hinge for joining and aligning a pair of panels, the method comprising the steps of:

providing a hinge having a first substantially flat leaf and a second substantially flat leaf, the first leaf and the second leaf being hingedly connected so that the leaves can pivot about a hinge axis;

forming a first arcuate flange along an outer edge of the first flat leaf generally opposite the hinge axis, the first arcuate flange being disposed along an imaginary first right circular cylinder having a center axis intersecting the hinge axis; and forming a second arcuate flange along an outer edge of the second flat leaf generally opposite the hinge axis, the second arcuate flange being disposed along an imaginary second right circular cylinder having a center axis intersecting the hinge axis and the first cylinder center axis.

* * * * *